US006711790B2

(12) United States Patent
Pontaoe

(10) Patent No.: US 6,711,790 B2
(45) Date of Patent: Mar. 30, 2004

(54) BUCKLE DEVICE

(75) Inventor: John S. Pontaoe, Chicago, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/012,011

(22) Filed: Dec. 6, 2001

(65) Prior Publication Data

US 2003/0106193 A1 Jun. 12, 2003

(51) Int. Cl.[7] ..... A44B 17/00
(52) U.S. Cl. ..... 24/633; 24/635; 24/664
(58) Field of Search ..... 24/625, 629, 633, 24/640–642, 636, 653, 656, 664, 614, 573.5, 573.1, 588; 297/468, 467, 483

(56) References Cited

U.S. PATENT DOCUMENTS

| | | | | | |
|---|---|---|---|---|---|
| 3,825,979 | A | * | 7/1974 | Jakob | 24/579.11 |
| 4,150,464 | A | | 4/1979 | Tracy | |
| 4,569,106 | A | | 2/1986 | Lovato | |
| 4,621,393 | A | | 11/1986 | Ambal | |
| 4,656,700 | A | * | 4/1987 | Tanaka et al. | 24/579.11 |
| 4,688,337 | A | | 8/1987 | Dillner | |
| 4,712,280 | A | | 12/1987 | Fildan | |
| 4,779,315 | A | | 10/1988 | Kohus | |
| 4,800,629 | A | | 1/1989 | Ikeda | |
| 4,809,410 | A | * | 3/1989 | Van Riesen | 24/579.11 |
| 4,831,694 | A | | 5/1989 | Kong | |
| 5,038,446 | A | * | 8/1991 | Anthony et al. | 24/579.11 |
| 5,170,539 | A | | 12/1992 | Lundstedt | |
| 5,203,058 | A | | 4/1993 | Krauss | |
| 5,222,279 | A | | 6/1993 | Frano et al. | |
| D340,886 | S | | 11/1993 | Anscher | |
| D341,105 | S | | 11/1993 | Lovato | |
| 5,283,933 | A | * | 2/1994 | Wiseman et al. | 24/642 |
| D349,262 | S | | 8/1994 | Krauss | |
| 5,383,257 | A | | 1/1995 | Krauss | |
| 5,406,681 | A | * | 4/1995 | Olson | 24/650 |
| 5,438,737 | A | | 8/1995 | Anscher et al. | |
| 5,507,076 | A | | 4/1996 | Anscher | |
| 5,542,161 | A | | 8/1996 | Anscher | |
| 5,546,642 | A | | 8/1996 | Anscher | |
| 5,551,131 | A | | 9/1996 | Anscher | |
| 5,604,964 | A | * | 2/1997 | Aoshima | 24/632 |
| 5,659,931 | A | | 8/1997 | Anscher | |
| 5,709,014 | A | | 1/1998 | Takahashi | |
| 5,735,024 | A | | 4/1998 | Ortiz | |
| 5,791,026 | A | | 8/1998 | Anscher | |
| 5,794,316 | A | | 8/1998 | Anscher | |
| D402,919 | S | | 12/1998 | Anscher | |
| 5,893,199 | A | | 4/1999 | Anscher | |
| 6,000,109 | A | | 12/1999 | Anscher | |
| 6,052,875 | A | | 4/2000 | Fudaki | |
| 6,061,883 | A | * | 5/2000 | Uehara | 24/625 |
| 6,393,677 | B1 | | 5/2002 | Anscher | |
| 6,408,494 | B1 | * | 6/2002 | Anscher | 24/625 |
| 6,463,638 | B1 | * | 10/2002 | Pontaoe | 24/614 |
| 6,543,101 | B2 | | 4/2003 | Sack et al. | 24/633 |
| 2002/0017012 | A1 | * | 2/2002 | Sack et al. | 24/633 |

* cited by examiner

*Primary Examiner*—Anthony Knight
*Assistant Examiner*—Andre' L. Jackson
(74) *Attorney, Agent, or Firm*—Mark W. Croll; Paul F. Donovan

(57) ABSTRACT

A buckle device is disclosed for releasably fastening together a first, second and third strap. The device includes a first plug attached to the first strap and a second plug attached to the second strap. A socket is attached to the third strap and a release button is molded separately from the socket and cooperates with the socket such that when the button is disposed in a first disposition relative to the socket, the first and second plugs are secured relative to the socket and when the button is disposed in a second disposition relative to the socket, the first and second plugs are released from the socket. The socket defines a catch which engages an opening when the tongue is inserted into a first hole such that the first plug is secured relative to the socket. Also, the socket defines a further catch which engages a further opening when the further tongue is inserted into a second hole such that the second plug is secured relative to the socket. The arrangement is such that when the button is disposed in the first disposition, the tongue and further tongue are secured within the socket and when the button is disposed in the second disposition thereof, the button deflects the tongue and the further tongue away from the catch and further catch respectively so that the opening disengages from the catch and the further opening disengages from the further catch such that the first and second plugs are released from the socket.

20 Claims, 11 Drawing Sheets

Fig. 7
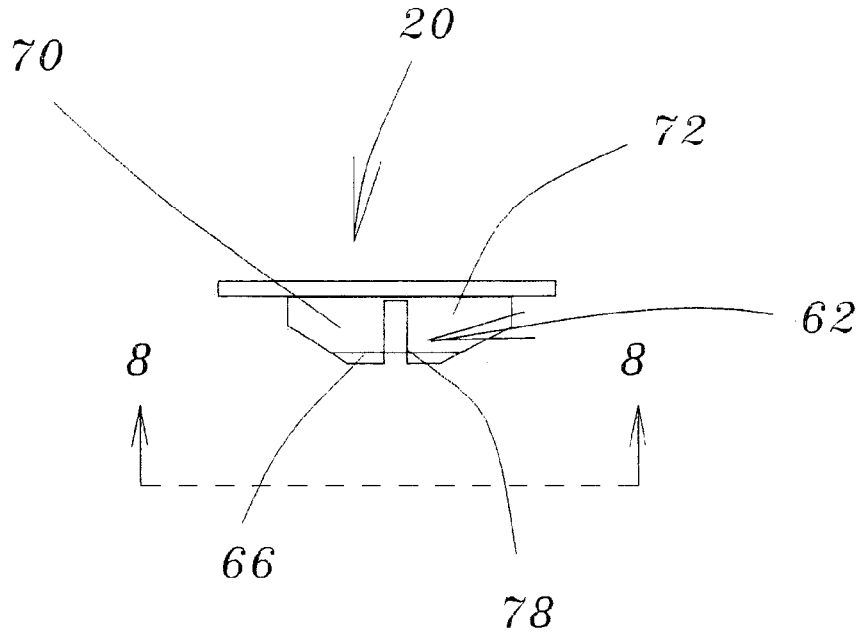
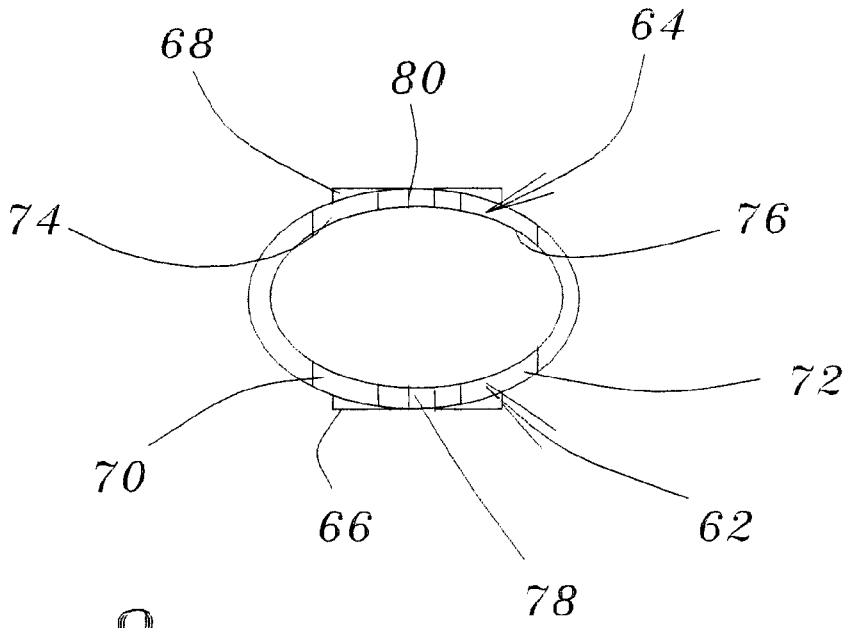
Fig. 8

BUCKLE DEVICE

FIELD OF THE INVENTION

The present invention relates to a buckle device for releasably fastening together a first, second and third strap. More specifically, the present invention relates to a three way buckle device for releasably fastening together a first, second and third strap.

BACKGROUND OF THE INVENTION

Buckles are used in child car seats and other types of child seats in order to safely secure a young child in the car seat or any other type of child seat. Typically, such buckles fasten together three straps with the center strap extending from the car seat or other anchor point to between the child's legs. The other straps are side straps which extend from the car seat or other anchor points around the shoulders of the child and releasably attach to the buckle so that the three straps securely hold the child within the car seat or the like. In this way, the center strap is permanently and adjustably secured to the three way buckle while the other two straps are readily releasable from the buckle.

Many different designs for three way buckles have been proposed. However, many of the prior art proposals are relatively complex and thus comparatively costly to manufacture.

The three way buckle according to the present invention is simple in design and provides an extremely reliable means for securely fastening the three straps together. Furthermore, the buckle according to the present invention enables the simultaneous release of both side straps. Also, because the release button, according to the present invention, is molded as a separate molding from the socket, the mold required for producing the socket is greatly simplified and the production of correctly molded sockets is enhanced.

Therefore, it is a primary feature of the present invention to provide a three way buckle that overcomes the problems associated with the prior art arrangements and which make a considerable contribution to the art of manufacturing buckles.

Another feature of the present invention is the provision of a three way buckle which simultaneously releases two of the straps from the buckle.

A further feature of the present invention is the provision of a three way buckle which has a separately molded release button.

Another feature of the present invention is the provision of a three way buckle which is simple in construction and thus of relatively low cost.

Other features and advantages of the buckle according to the present invention will be readily apparent to those skilled in the art by a consideration of the detailed description of a preferred embodiment of the invention contained herein.

SUMMARY OF THE INVENTION

The present invention relates to a buckle device for releasably fastening together a first, second and third strap. The device includes a first plug which is attached to the first strap and a second plug which is attached to the second strap. A socket is attached to the third strap and a release button is molded separately from the socket. The button cooperates with the socket such that when the button is disposed in a first disposition relative to the socket, the first and second plugs are secured relative to the socket. However, when the button is disposed in a second disposition relative to the socket, the first and second plugs are released from the socket. The first plug includes an attaching portion for attaching the first plug to the first strap and a tongue projecting from the attaching portion for insertion into the socket. The tongue defines an opening and a first and a second slide are disposed spaced and parallel relative to each other so that the tongue is disposed between the first and second slide. The second plug includes a further attaching portion for attaching the second plug to the second strap. A further tongue projects from the further attaching portion for insertion into the socket, the further tongue defining a further opening. A first and a second rail are disposed spaced and parallel relative to each other so that the further tongue is disposed between the first and second rail. The socket defines a first and a second hole, the first hole slidably receiving therein the tongue of the first plug and the second hole slidably receives therein the further tongue of the second plug. The socket defines a catch which engages the opening when the tongue is inserted into the first hole such that the first plug is secured relative to the socket. Also, the socket defines a further catch which engages the further opening when the further tongue is inserted into the second hole such that the second plug is secured relative to the socket. The arrangement is such that when the button is disposed in the first disposition, the tongue and further tongue are secured within the socket and when the button is disposed in the second disposition thereof, the button deflects the tongue and the further tongue away from the catch and further catch respectively so that the opening disengages from the catch and the further opening disengages from the further catch such that the first and second plugs are released from the socket.

In a more specific embodiment of the present invention, the plugs and the socket are fabricated from plastics material.

Furthermore, the socket further defines an aperture for the slidable reception therein of the button. More specifically, the aperture is of oval shaped configuration and the aperture is equidistantly spaced from the first and the second hole. Additionally, the socket includes an upstanding rim which surrounds the aperture. Moreover, the socket includes an attachment eye for attachment to the third strap. Also, the socket includes a partition which is disposed between the first hole and the second hole for partitioning the first hole from the second hole.

In a preferred embodiment of the present invention, the socket includes a first support for supporting the catch and a second support for supporting the further catch. The second support is disposed opposite to the first support within the aperture. Moreover, the partition is disposed between the first hole and the second hole for partitioning the first hole from the second hole, the partition being disposed between the first and second supports.

The button includes a first depending leg which cooperates with the tongue and the further tongue so that when the button is disposed in the second disposition thereof, the first leg deflects the tongue and the further tongue so that the catch disengages from the opening and the further catch disengages from the further opening.

Also, a second depending leg cooperates with the tongue and the further tongue so that when the button is disposed in the second disposition thereof, the second leg deflects the tongue and the further tongue so that the catch disengages from the opening and the further catch disengages from the further opening. The second leg is disposed opposite to the first leg.

The button further includes a ridge which extends outwardly from the first leg for retaining the button relative to the socket. Also, a further ridge extends outwardly from the second leg for retaining the button relative to the socket, the further ridge being disposed opposite to the ridge.

More specifically, the first leg includes a first and a second member, the first member cooperating with the tongue and the second member cooperating with the further tongue. The second leg includes a first and a second portion, the first portion cooperating with the tongue and the second portion cooperating with the further tongue.

The partition is disposed between the first hole and the second hole for partitioning the first hole from the second hole, the arrangement being such that the partition is disposed between the first member and the second member, the partition also being disposed between the first portion and the second portion.

More particularly, the first leg defines a slot which is disposed between the first and second members, the slot receiving therein the partition. Also, the second leg defines a further slot which is disposed between the first and second portions, the further slot receiving therein the partition such that the button rides upon and is guided by the partition.

The tongue has a proximal and a distal end, the proximal end extending from the attaching portion. Also, the opening extends through the tongue, the opening having a leading edge. The tongue includes a guide disposed between the distal end of the tongue and the leading edge of the opening. The arrangement is such that when the first plug is inserted into the first hole, the guide slides against the catch until the catch reaches the leading edge of the opening whereat, the catch enters the opening for retaining the tongue within the first hole of the socket.

Additionally, the further tongue has a first and a second end, the first end of the further tongue extending from the further attaching portion. The further opening extends through the further tongue, the further opening having a front edge. The further tongue includes a further guide which is disposed between the second end of the further tongue and the front edge of the further opening. The arrangement is such that when the second plug is inserted into the second hole, the further guide slides against the further catch until the further catch reaches the front edge of the further opening whereat, the further catch enters the further opening for retaining the further tongue within the second hole of the socket.

The slides are of L-shaped cross sectional configuration and the socket includes a first and second protrusion which cooperate with the slides for guiding the tongue into the first hole. Also, the rails are of L-shaped cross sectional configuration and the socket includes a first and second rib which cooperate with the rails for guiding the further tongue into the second hole.

Also, the plugs are interchangeable relative to the holes and depression of the button to the second disposition thereof simultaneously releases both plugs from the socket.

Other features and advantages of the invention will become apparent to those skilled in the art upon review of the following detailed description, claims and drawings in which like numerals are used to designate like features.

BRIEF DESCRIPTION OF THE DRAWINGS

FIG. 7 is an enlarged side elevational view of the button;

FIG. 8 is a view taken on the line 8—8 of FIG. 7;

Similar reference characters refer to similar parts throughout the various views of the drawings.

Figure 1:
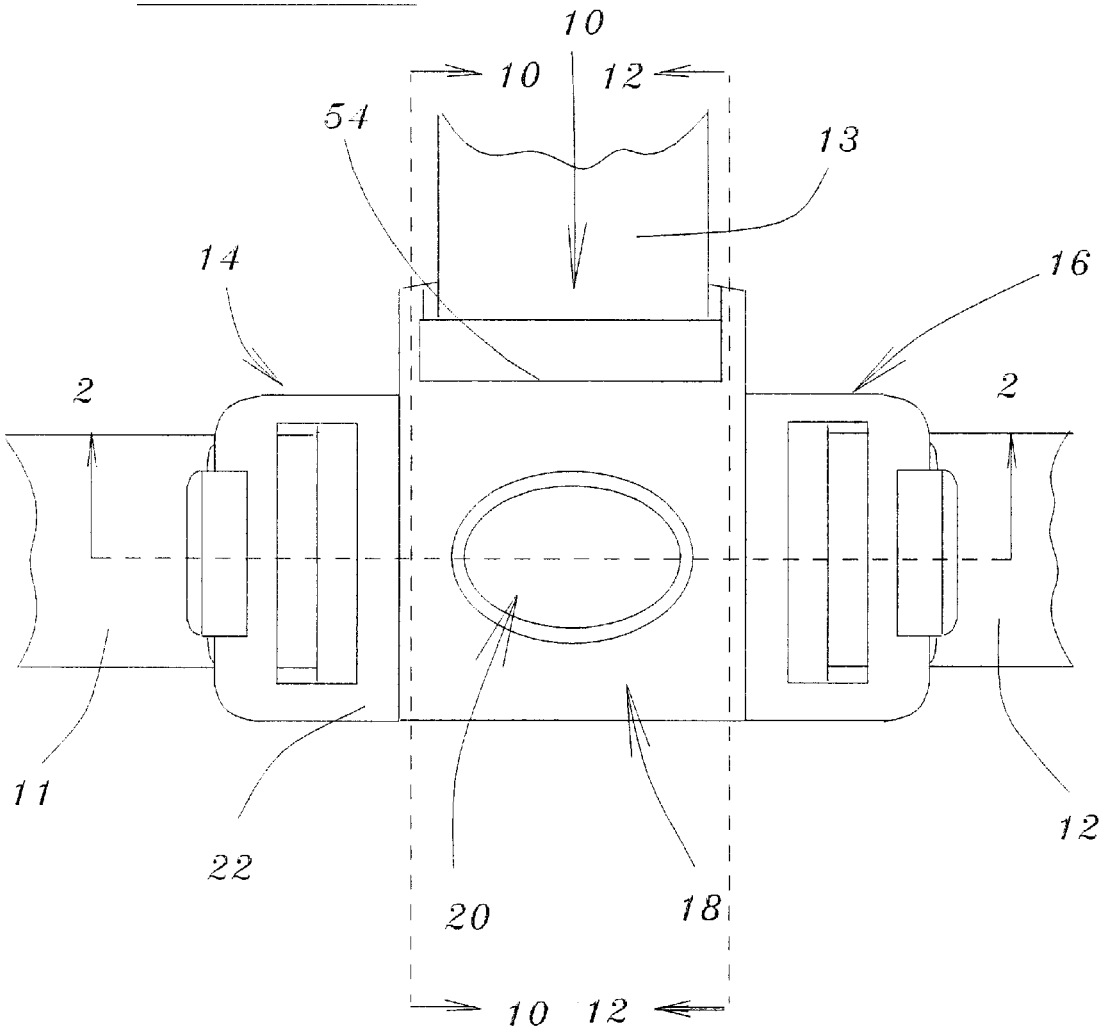
FIG. 1 is a top plan view of a buckle device according to the present invention.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE PREFERRED EMBODIMENT

FIG. 1 is a top plan view of a buckle device generally designated 10 according to the present invention for releasably fastening together a first, second and third strap 11, 12, and 13 respectively. The device 10 includes a first plug generally designated 14 which is attached to the first strap 11 and a second plug generally designated 16 which is attached to the second strap 12. A socket generally designated 18 is attached to the third strap 13 and a release button generally designated 20 is molded separately from the socket 18 and cooperates with the socket 18.

Figure 2:
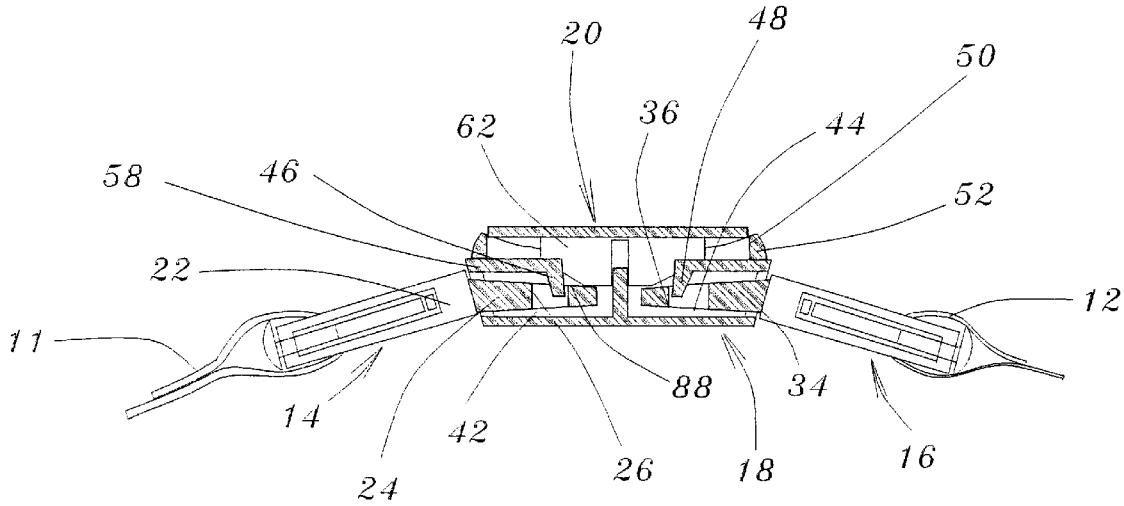
FIG. 2 is a sectional view taken on the line 2—2 of FIG. 1.

FIG. 2 is a sectional view taken on the line 2—2 of FIG. 1. As shown in FIG. 2, the arrangement is such that when the button 20 is disposed in a first disposition relative to the socket 18 as shown in FIG. 2, the first and second plugs 14 and 16 respectively are secured relative to the socket 18.

Figure 3:
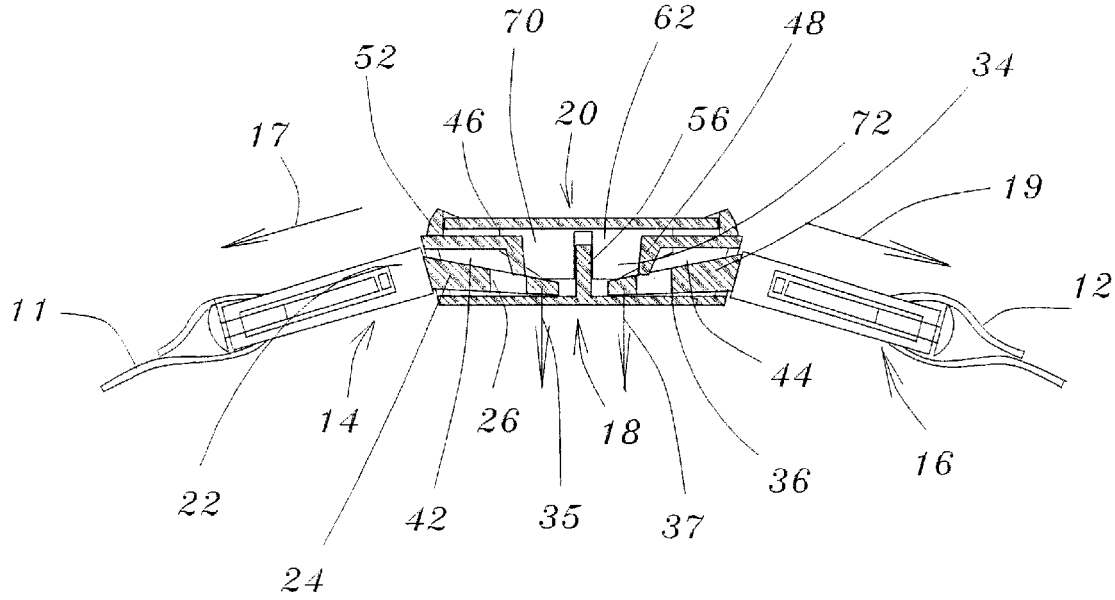
FIG. 3 is a similar view to that shown in FIG. 2 but shows the release button depressed.

FIG. 3 is a similar view to that shown in FIG. 2 but shows the release button 20 depressed. As shown in FIG. 3, when the button 20 is disposed in a depressed second disposition relative to the socket 18, the first and second plugs 14 and 16 respectively are released from the socket 18 as indicated by the arrows 17 and 19 respectively. The first plug 14 includes an attaching portion 22 for attaching the first plug 14 to the first strap 11 and a tongue 24 projecting from the attaching portion 22 for insertion into the socket 18. The tongue 24 defines an opening 26. As will be appreciated by those skilled in the art, the straps or webbing can be connected to the plugs in any number of ways, and one such way is shown in FIGS. 2 and 3

Figure 4:
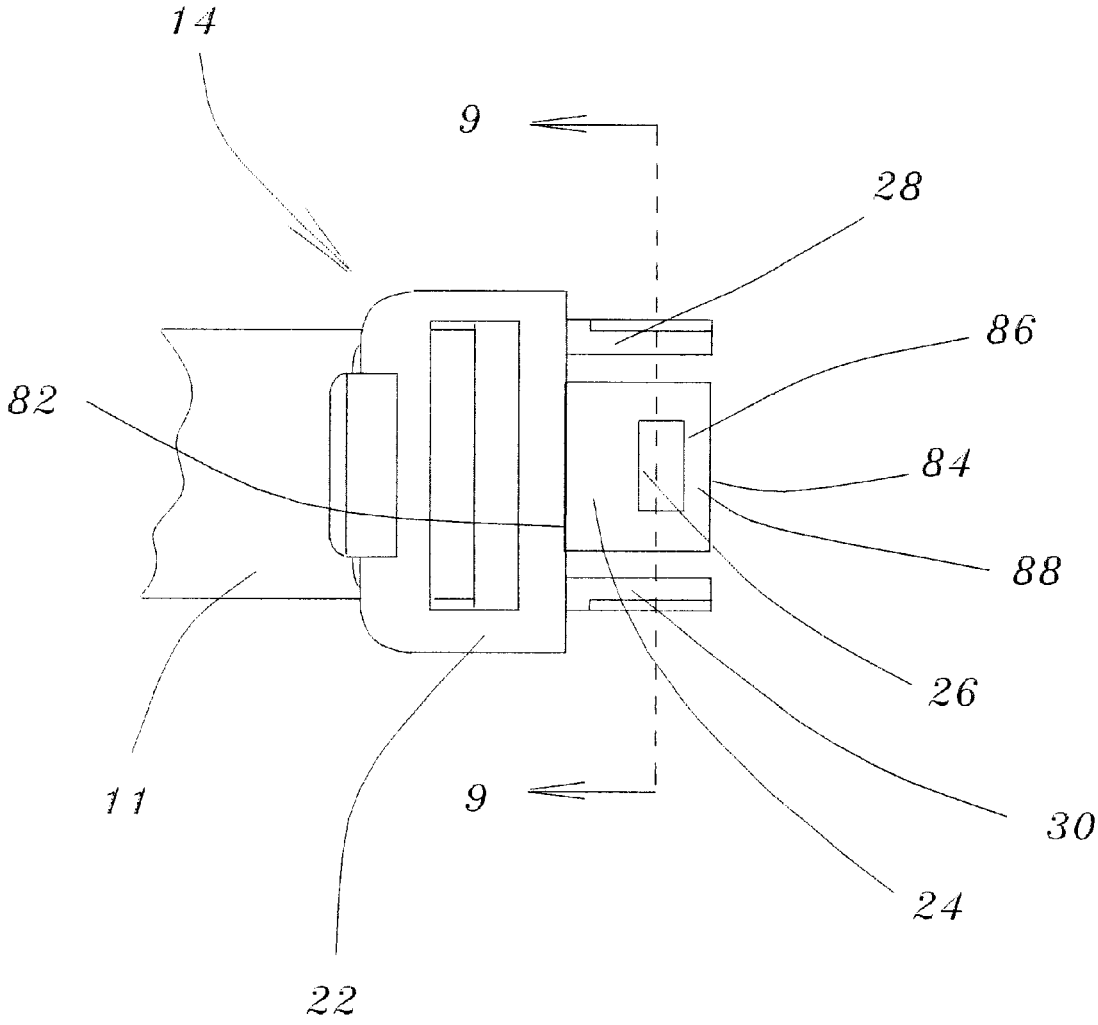
FIG. 4 is an enlarged view of one of the plugs removed from the socket.

FIG. 4 is an enlarged view of the plug 14 removed from the socket 18. As shown in FIG. 4, the plug 14 includes a first and a second slide 28 and 30 respectively which are disposed spaced and parallel relative to each other so that the tongue 24 is disposed between the first and second slide 28 and 30.

Figure 5:
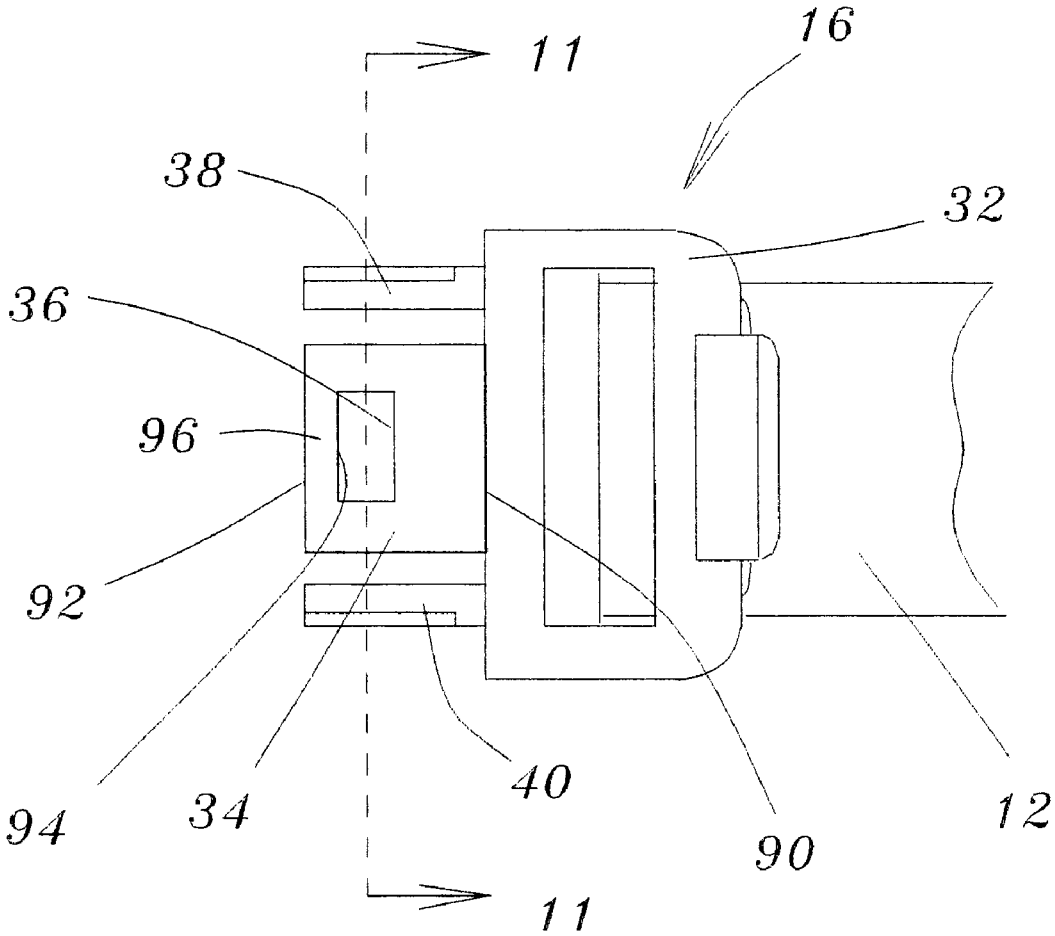
FIG. 5 is an enlarged view of the other plug removed from the socket.

FIG. 5 is an enlarged view of the plug 16 removed from the socket 18. As shown in FIG. 5, the second plug 16 includes a further attaching portion 32 for attaching the second plug 16 to the second strap 12. A further tongue 34 projects from the further attaching portion 32 for insertion into the socket 18, the further tongue 34 defining a further opening 36. A first and a second rail 38 and 40 respectively are disposed spaced and parallel relative to each other so that the further tongue 34 is disposed between the first and second rail 38 and 40.

As shown in FIGS. 2 and 3, the socket 18 defines a first and a second hole 42 and 44 respectively, the first hole 42 slidably receiving therein the tongue 24 of the first plug 14. The second hole 44 slidably receives therein the further tongue 34 of the second plug 16. The socket 18 defines a catch 46 which engages the opening 26 when the tongue 24 is inserted into the first hole 42 such that the first plug 14 is secured relative to the socket 18. Also, the socket 18 defines a further catch 48 which engages the further opening 36 when the further tongue 34 is inserted into the second hole 44 such that the second plug 16 is secured relative to the socket 18. The arrangement is such that when the button 20 is disposed in the first disposition, as shown in FIG. 2, the tongue and further tongue 24 and 34 respectively are secured within the socket 18 and when the button 20 is disposed in the second disposition thereof, as shown in FIG. 3, the button 20 deflects the tongue 24 and the further tongue 34 away from the catch 46 and further catch 48 respectively as indicated by the arrows 35 and 37 respectively so that the opening 26 disengages from the catch 46 and the further opening 36 disengages from the further catch 48 as shown in FIG. 3 such that the first and second plugs 14 and 16 are released from the socket 18.

In a more specific embodiment of the present invention, the plugs 14 and 16 and the socket 18 are fabricated from plastics material.

Furthermore, the socket 18 further defines an aperture 50, as shown in FIG. 2 for the slidable reception therein of the button 20.

Also, the aperture 50 is of oval shaped configuration as shown in FIG. 1 and the aperture 50 is equidistantly spaced from the first and the second hole 42 and 44 respectively.

Additionally, the socket 18 includes an upstanding rim 52 which surrounds the aperture 50.

Moreover, as shown in FIG. 1, the socket 18 includes an attachment eye 54 for attachment to the third strap 13.

Figure 6:
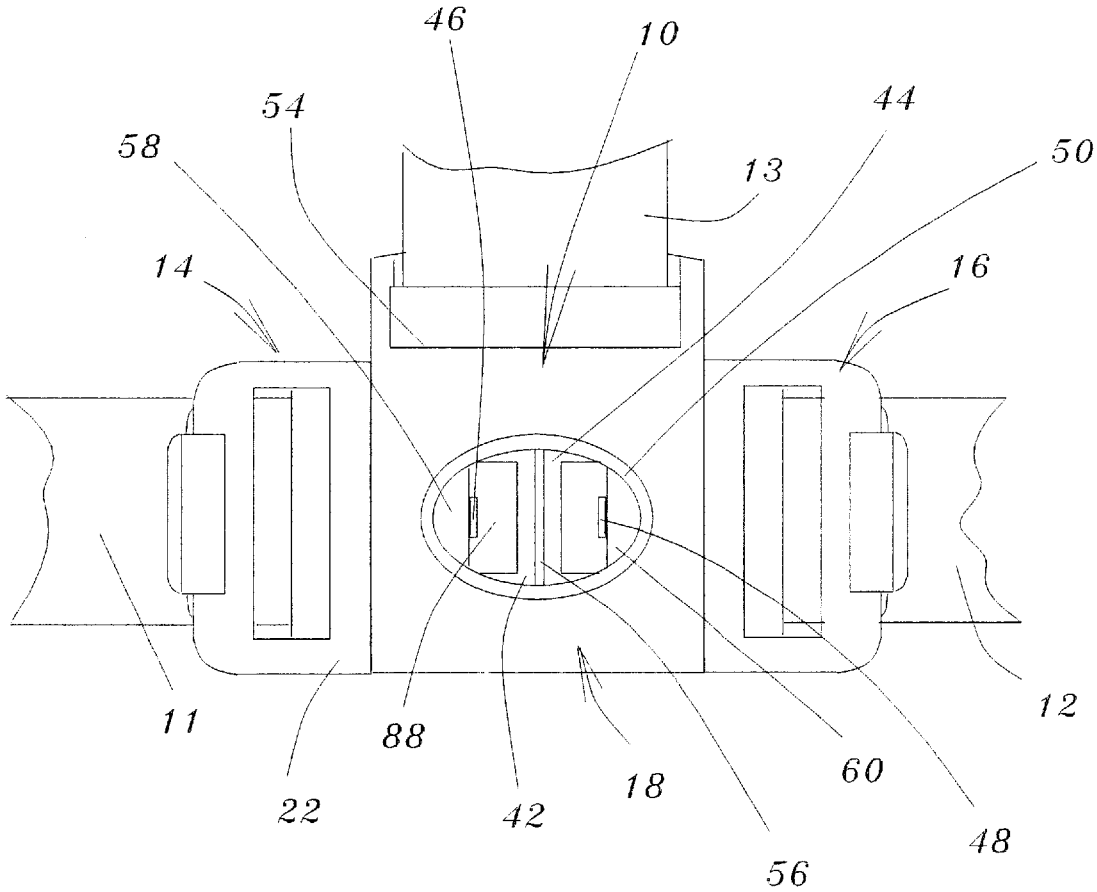
FIG. 6 is a similar view to that shown in FIG. 1 but with the button removed.

FIG. 6 is a similar view to that shown in FIG. 1 but with the button 20 removed. As shown in FIG. 6, the socket 18 includes a partition 56 disposed between the first hole 42 and the second hole 44 for partitioning the first hole 42 from the second hole 44.

In a preferred embodiment of the present invention, the socket 18 includes a first support 58 for supporting the catch 46 and a second support 60 for supporting the further catch 48, the second support 60 being disposed opposite to the first support 58 within the aperture 50. Moreover, the partition 56 is disposed between the first hole 42 and the second hole 44 for partitioning the first hole 42 from the second hole 44, the partition 56 being disposed between the first and second supports 58 and 60 respectively.

FIG. 7 is an enlarged side elevational view of the button 20. As shown in FIG. 7, the button 20 includes a first depending leg generally designated 62 which cooperates with the tongue 24 and the further tongue 34 as shown in FIG. 2, so that when the button 20 is disposed in the second disposition thereof, as shown in FIG. 3, the first leg 62 deflects the tongue 24 and the further tongue 34 so that the catch 46 disengages from the opening 26 and the further catch 48 disengages from the further opening 36.

FIG. 8 is a view taken on the line 8—8 of FIG. 7. As shown in FIG. 8, a second depending leg generally designated 64 cooperates with the tongue 24 and the further tongue 34 so that when the button 20 is disposed in the second disposition thereof, the second leg 64 deflects the tongue 24 and the further tongue 34 so that the catch 46 disengages from the opening 26 and the further catch 48 disengages from the further opening 36 as shown in FIG. 3. The second leg 64 is disposed opposite to the first leg 62. Those skilled in the art will appreciate that within the scope of the present invention, the guiding legs or pegs 62 and 64 may be slightly modified for fit and function. For example, the legs 62 and 64 may be provided with extra material to minimize movement between the associated plug and socket when the plug is connected to the socket.

The button 20 further includes a ridge 66 which extends outwardly from the first leg 62 for retaining the button 20 within the aperture 50 and relative to the socket 18. Also, a further ridge 68 extends outwardly from the second leg 64 for retaining the button 20 within the aperture 50 and relative to the socket 18.

More specifically, the first leg 62 includes a first and a second member 70 and 72 respectively, the first member 70 cooperating with the tongue 24 and the second member 72 cooperating with the further tongue 34. The second leg 64 includes a first and a second portion 74 and 76 respectively, the first portion 74 cooperating with the tongue 24 and the second portion 76 cooperating with the further tongue 34 as shown in FIGS. 2 and 3.

The partition 56 is disposed between the first hole 42 and the second hole 44 for partitioning the first hole 42 from the second hole 44, the arrangement being such that the partition 56 is disposed between the first member and the second member 70 and 72 respectively, the partition 56 also being disposed between the first portion and the second portion 74 and 76 respectively.

More particularly, the first leg 62 defines a slot 78 which is disposed between the first and second members 70 and 72 respectively, the slot 78 receiving therein the partition 56 as shown in FIGS. 2 and 3. Also, the second leg 64 defines a further slot 80 which is disposed between the first and second portions 74 and 76 respectively, the further slot 80 receiving therein the partition 56 such that the button 20 rides upon and is guided by the partition 56.

As shown in FIG. 4, the tongue 24 has a proximal and a distal end 82 and 84 respectively, the proximal end 82 extending from the attaching portion 22. Also, the opening 26 extends through the tongue 24, the opening 26 having a leading edge 86. The tongue 24 includes a guide 88 disposed between the distal end 84 of the tongue 24 and the leading edge 86 of the opening 26. The arrangement is such that when the first plug 14 is inserted into the first hole 42, the guide 88 slides against the catch 46 until the catch 46 reaches the leading edge 86 of the opening 26 whereat, the catch 46 enters the opening 26 for retaining the tongue 24 within the first hole 42 of the socket 18 as shown in FIG. 2.

Additionally, as shown in FIG. 5, the further tongue 34 has a first and a second end 90 and 92 respectively, the first end 90 of the further tongue 34 extending from the further attaching portion 32. The further opening 36 extends through the further tongue 34, the further opening 36 having a front edge 94. The further tongue 34 includes a further guide 96 which is disposed between the second end 92 of the further tongue 34 and the front edge 94 of the further opening 36. The arrangement is such that when the second plug 16 is inserted into the second hole 44, the further guide 96 slides against the further catch 48 until the further catch 48 reaches the front edge 94 of the further opening 36 whereat, the further catch 48 enters the further opening 36 for retaining the further tongue 34 within the second hole 44 of the socket 18 as shown in FIG. 2.

Figure 9:
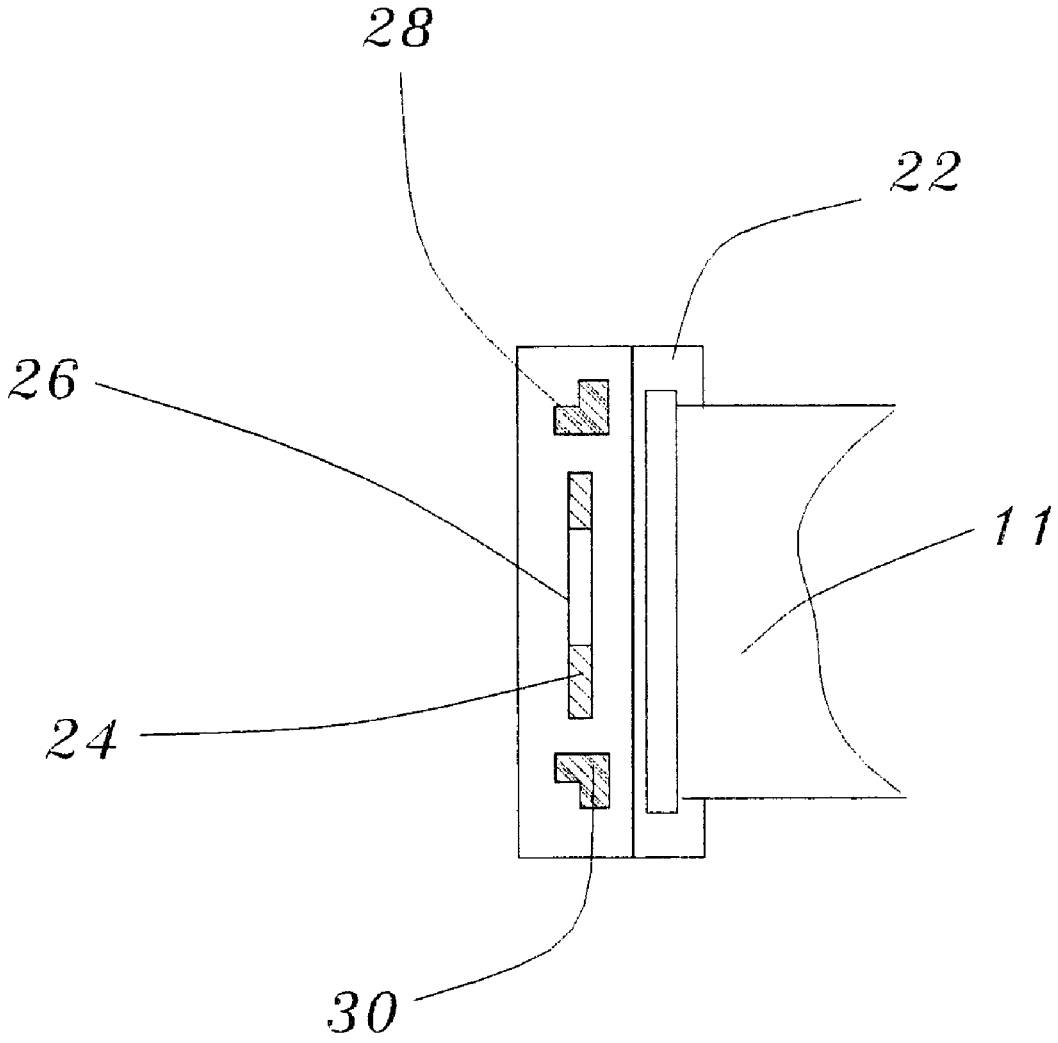
FIG. 9 is a sectional view taken on the line 9—9 of FIG. 4.

FIG. 9 is a sectional view taken on the line 9—9 of FIG. 4. As shown in FIG. 9, the slides 28 and 30 respectively are of L-shaped cross sectional configuration.

Figure 10:
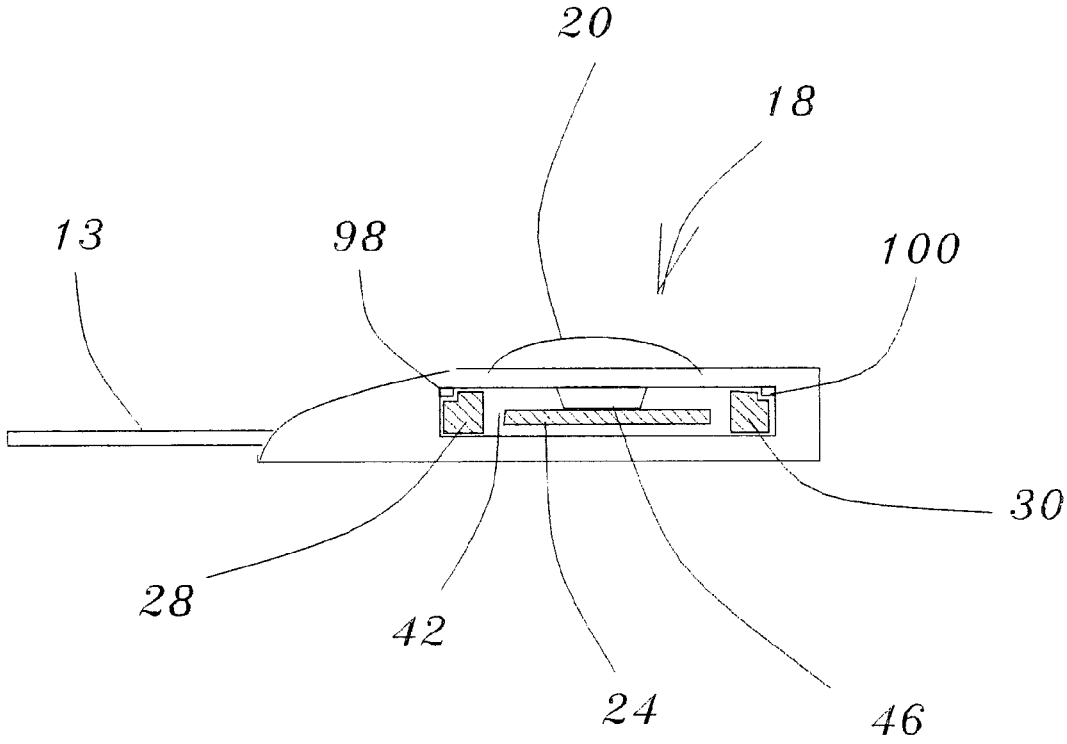
FIG. 10 is a sectional view taken on the line 10—10 of FIG. 1.

FIG. 10 is a sectional view taken on the line 10—10 of FIG. 1. As shown in FIG. 10, the socket 18 includes a first and second protrusion 98 and 100 respectively which cooperate with the L-shaped slides 28 and 30 respectively for guiding the tongue 24 into the first hole 42.

Figure 11:
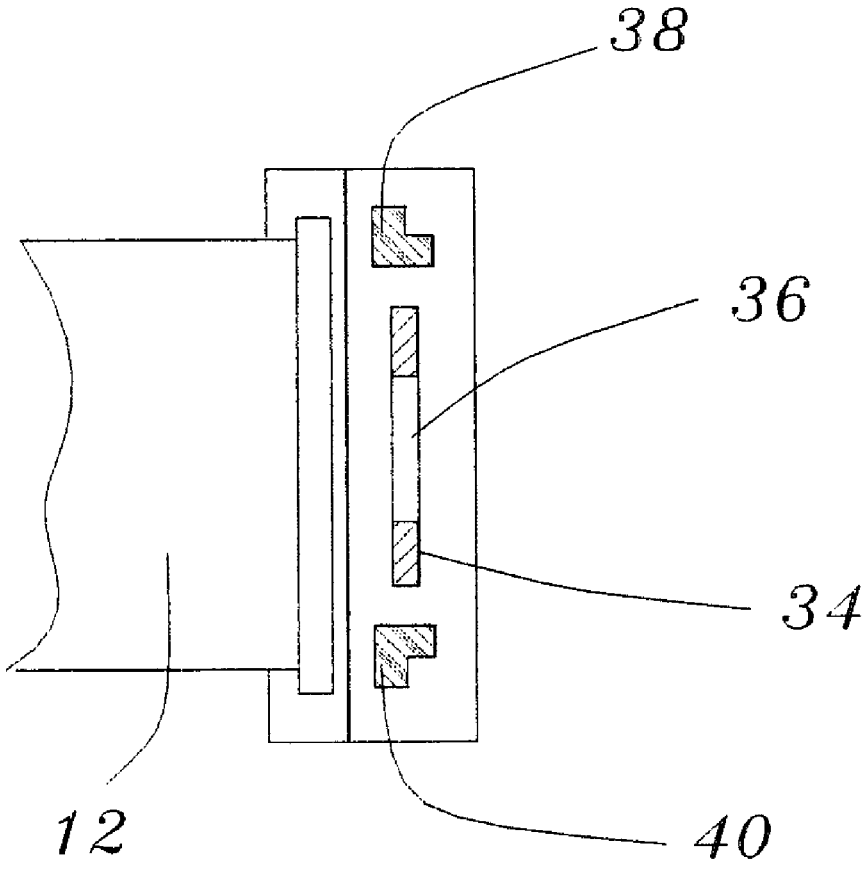
FIG. 11 is a sectional view taken on the line 11—11 of FIG. 5.

FIG. 11 is a sectional view taken on the line 11—11 of FIG. 5. As shown in FIG. 11, the rails 38 and 40 respectively are of L-shaped cross sectional configuration.

Figure 12:
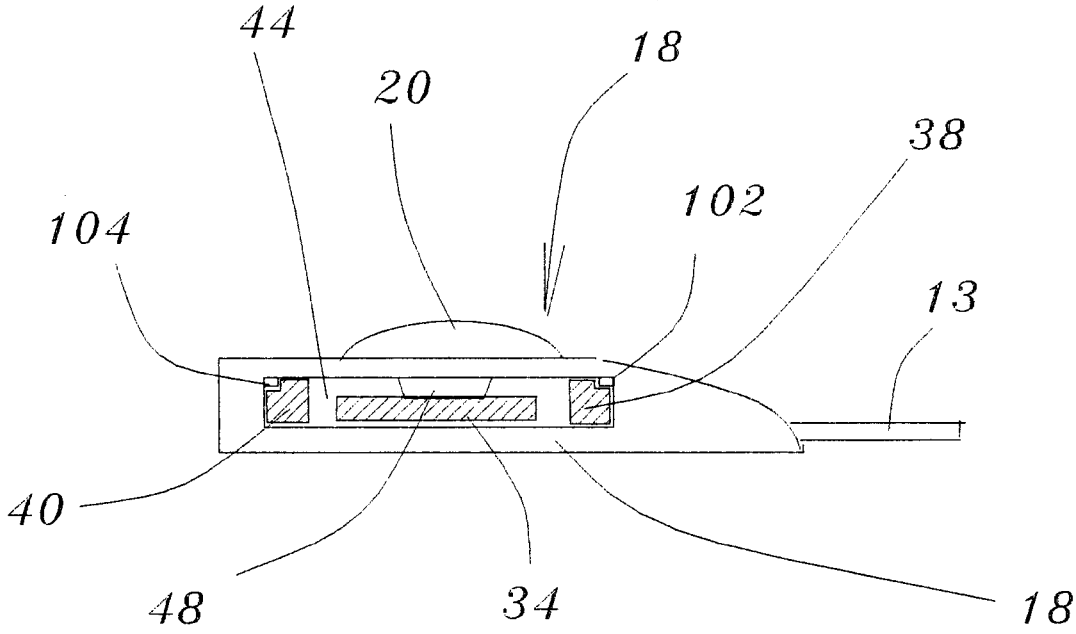
FIG. 12 is a sectional view taken on the line 12—12 of FIG. 1.

FIG. 12 is a sectional view taken on the line 12—12 of FIG. 1. As shown in FIG. 12, the socket 18 includes a first and second rib 102 and 104 respectively which cooperate with the rails 38 and 40 respectively for guiding the further tongue 34 into the second hole 44.

Also, the plugs 14 and 16 are interchangeable relative to the holes 42 and 44 and depression of the button 20 to the second disposition thereof simultaneously releases both plugs 14 and 16 from the socket 18.

In operation of the device according to the present invention, the third strap 13 is adjustably secured through the attaching eye 54 and the first plug 14 is fastened to the first strap 11 by means of the attaching portion 22 as is well known in the art so that the length of the first strap 11 is adjusted to the correct dimension. The same procedure is carried out with regard to attaching the second strap 12 to the further attaching portion 32.

When the plugs 14 and 16 are inserted into the holes 42 and 44 respectively, the tongues 24 and 34 flex until the catch and further catch 46 and 48 engage the opening and further opening 26 and 36 respectively so that the plugs 14 and 16 are securely and reliably anchored within the socket 18. However, in order to release the plugs 14 and 16 from the socket 18, the button 20 is depressed so that the leg and further leg 62 and 64 respectively urge the tongue and further tongue 24 and 34 out of engagement with the catch and further catch 46 and 48 so that the plugs are released from the socket. Such flexing of the tongue and further tongue 24 and 34 is permitted because the plugs 14 and 16 are positively located by means of the L-shaped slides 28 and 30 and the L-shaped rails 38 and 40.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A buckle device for releasably fastening together a first, second and third strap, said device comprising:

a first plug attached to the first strap;

a second plug attached to the second strap;

a socket attached to the third strap; and a release button molded separately from said socket and cooperating with said socket such that when said button is disposed in a first disposition relative to said socket, said first and second plugs are secured relative to said socket and when said button is moved in a first direction and disposed in a second disposition relative to said socket, said first and second plugs are released from said socket;

said first plug including an attaching portion for attaching said first plug to the first strap;

a tongue projecting from said attaching portion for insertion into said socket, said tongue defining an opening;

a first and a second slide disposed spaced and parallel relative to each other so that said tongue is disposed between said first and second slide;

said second plug including a further attaching portion for attaching said second plug to the second strap;

a further tongue projecting from said further attaching portion for insertion into said socket, said further tongue defining a further opening;

a first and a second rail disposed spaced and parallel relative to each other so that said further tongue is disposed between said first and second rail;

said socket defining a first and a second hole, said first hole slidably receiving therein said tongue of said first plug, said second hole slidably receiving therein said further tongue of said second plug;

a catch which engages said opening when said tongue is inserted into said first hole such that said first plug is secured relative to said socket; and a further catch which engages said further opening when said further tongue is inserted into said second hole such that said second plug is secured relative to said socket, and such that when said button is disposed in said first disposition, said tongue and further tongue are secured within said socket and when said button is disposed in said second disposition thereof, said button deflects said tongue and said further tongue in a second direction which is substantially parallel to said first direction and away from said catch and further catch respectively so that said opening disengages from said catch and said further opening disengages from said further catch such that said first and second plugs are released from said socket.

2. A buckle device as set forth in claim 1 wherein said plugs and said socket are fabricated from plastics material.

3. A buckle device as set forth in claim 1 wherein said socket includes an attachment eye for attachment to the third strap.

4. A buckle device as set forth in claim 1 wherein said socket includes a partition disposed between said first hole and said second hole for partitioning said first hole from said second hole.

5. A buckle device as set forth in claim 1 wherein said tongue has a proximal and a distal end, said proximal end extending from said attaching portion;

said opening extending through said tongue, said opening having a leading edge;

said tongue including a guide disposed between said distal end of said tongue and said leading edge of said opening, the arrangement being such that when said first plug is inserted into said first hole, said guide slides against said catch until said catch reaches said leading edge of said opening whereat, said catch enters said opening for retaining said tongue within said first hole of said socket;

said further tongue has a first and a second end, said first end of said further tongue extending from said further attaching portion;

said further opening extending through said further tongue, said further opening having a front edge;

said further tongue including a further guide disposed between said second end of said further tongue and said front edge of said further opening, and such that when said second plug is inserted into said second hole, said further guide slides against said further catch until said further catch reaches said front edge of said further opening whereat, said further catch enters said further opening for retaining said further tongue within said second hole of said socket.

6. A buckle device as set forth in claim 1 wherein said slides are of L-shaped cross sectional configuration;

said socket including a first and second protrusion which cooperate with said slides for guiding said tongue into said first hole;

said rails are of L-shaped cross sectional configuration; and said socket further including a first and second rib which cooperate with said rails for guiding said further tongue into said second hole.

7. A buckle device as set forth in claim 1 wherein said plugs are interchangeable relative to said holes.

8. A buckle device as set forth in claim 1 wherein depression of said button to said second disposition thereof simultaneously releases both plugs from said socket.

9. A buckle device as set forth in claim 1 wherein said socket further defines an aperture for the slidable reception therein of said button.

10. A buckle device as set forth in claim 9 wherein said aperture is of oval shaped configuration.

11. A buckle device as set forth in claim 9 said aperture is equidistantly spaced from said first and said second hole.

12. A buckle device as set forth in claim 9 wherein said socket includes an upstanding rim which surrounds said aperture.

13. A buckle device as set forth in claim 9 wherein said socket includes a first support for supporting said catch;

a second support for supporting said further catch, said second support being disposed opposite to said first support within said aperture; and a partition disposed between said first hole and said second hole for partitioning said first hole from said second hole, said partition being disposed between said first and second supports.

14. A buckle device as set forth in claim 1 wherein said button includes a first depending leg which cooperates with said tongue and said further tongue so that when said button is disposed in said second disposition thereof, said first leg deflects said tongue and said further tongue so that said catch disengages from said opening and said further catch disengages from said further opening; and a second depending leg which cooperates with said tongue and said further tongue so that when said button is disposed in said second disposition thereof, said second leg deflects said tongue and said further tongue so that said catch disengages from said opening and said further catch disengages from said further opening, said second leg being disposed opposite to said first leg.

15. A buckle device as set forth in claim 14 wherein said button further includes a ridge which extends outwardly from said first leg for retaining said button relative to said socket; and a further ridge which extends outwardly from said second leg for retaining said button relative to said socket.

16. A buckle device as set forth in claim 14, wherein said first leg includes a first and a second member, said first member cooperating with said tongue and said second member cooperating with said further tongue; and said second leg includes a first and a second portion, said first portion cooperating with said tongue and said second portion cooperating with said further tongue;

said socket including a partition disposed between said first hole and said second hole for partitioning said first hole from said second hole, the arrangement being such that said partition is disposed between said first member and said second member, said partition also being disposed between said first portion and said second portion.

17. A buckle device as set forth in claim 16, wherein said first leg defines a slot disposed between said first and second members, said slot receiving therein said partition; and said second leg defines a further slot disposed between said first and second portions, said further slot receiving therein said partition such that said button rides upon and is guided by said partition.

18. A buckle device for releasably fastening together a first, second and third strap, said device comprising:

a first plug attached to the first strap;

a second plug attached to the second strap;

a socket attached to the third strap; and a release button molded separately from said socket and cooperating with said socket such that when said button is disposed in a first disposition relative to said socket, said first and second plugs are secured relative to said socket and when said button is disposed in a second disposition relative to said socket, said first and second plugs are released from said socket;

said first plug including an attaching portion for attaching said first plug to the first strap;

a tongue projecting from said attaching portion for insertion into said socket, said tongue defining an opening;

a first and a second slide disposed spaced and parallel relative to each other so that said tongue is disposed between said first and second slide;

said second plug including a further attaching portion for attaching said second plug to the second strap;

a further tongue projecting from said further attaching portion for insertion into said socket, said further tongue defining a further opening;

a first and a second rail disposed spaced and parallel relative to each other so that said further tongue is disposed between said first and second rail;

said socket defining a first and a second hole, said first hole slidably receiving therein said tongue of said first plug, said second hole slidably receiving therein said further tongue of said second plug;

a catch which engages said opening when said tongue is inserted into said first hole such that said first plug is secured relative to said socket;

a further catch which engages said further opening when said further tongue is inserted into said second hole such that said second plug is secured relative to said socket, the arrangement being such that when said button is disposed in said first disposition, said tongue and further tongue are secured within said socket and when said button is disposed in said second disposition thereof, said button deflects said tongue and said further tongue away from said catch and further catch respectively so that said opening disengages from said catch and said further opening disengages from said further catch such that said first and second plugs are released from said socket;

wherein depression of said button to said second disposition thereof simultaneously releases both plugs from said socket;

said socket further defining an aperture for the slidable reception therein of said button, said aperture being of oval shaped configuration and equidistantly spaced from said first and said second hole;

said socket including an upstanding rim which surrounds said aperture;

an attachment eye for attachment to the third strap;

a partition disposed between said first hole and said second hole for partitioning said first hole from said second hole;

a first support for supporting said catch;

a second support for supporting said further catch, said second support being disposed opposite to said first support within said aperture;

said partition being disposed between said first and second supports;

said button including a first depending leg which cooperates with said tongue and said further tongue so that when said button is disposed in said second disposition thereof, said first leg deflects said tongue and said further tongue so that said catch disengages from said opening and said further catch disengages from said further opening;

a second depending leg which cooperates with said tongue and said further tongue so that when said button is disposed in said second disposition thereof, said second leg deflects said tongue and said further tongue so that said catch disengages from said opening and said further catch disengages from said further opening, said second leg being disposed opposite to said first leg;

a ridge which extends outwardly from said first leg for retaining said button relative to said socket;

a further ridge which extends outwardly from said second leg for retaining said button relative to said socket;

said first leg including a first and a second member, said first member cooperating with said tongue and said second member cooperating with said further tongue;

said second leg including a first and a second portion, said first portion cooperating with said tongue and said second portion cooperating with said further tongue;

said first leg defining a slot disposed between said first and second members, said slot receiving therein said partition;

said second leg defining a further slot disposed between said first and second portions, said further slot receiving therein said partition such that said button rides upon and is guided by said partition;

said tongue having a proximal and a distal end, said proximal end extending from said attaching portion;

said opening extending through said tongue, said opening having a leading edge;

said tongue including a guide disposed between said distal end of said tongue and said leading edge of said opening, the arrangement being such that when said first plug is inserted into said first hole, said guide slides against said catch until said catch reaches said leading edge of said opening whereat, said catch enters said opening for retaining said tongue within said first hole of said socket;

said further tongue including a first and a second end, said first end of said further tongue extending from said further attaching portion;

said further opening extending through said further tongue, said further opening having a front edge;

a further guide disposed between said second end of said further tongue and said front edge of said further opening, the arrangement being such that when said second plug is inserted into said second hole, said further guide slides against said further catch until said further catch reaches said front edge of said further opening whereat, said further catch enters said further opening for retaining said further tongue within said second hole of said socket;

said slides being of L-shaped cross sectional configuration;

said socket including a first and second protrusion which cooperate with said slides for guiding said tongue into said first hole;

said rails are of L-shaped cross sectional configuration;

said socket including a first and second rib which cooperate with said rails for guiding said further tongue into said second hole; and said plugs being interchangeable relative to said holes.

19. A buckle device for releasably fastening together a first, second and third strap, said device comprising:

a first plug attached to the first strap;

a second plug attached to the second strap;

a socket attached to the third strap; and a release button molded separately from said socket and cooperating with said socket such that when said button is disposed in a first disposition relative to said socket, said first and second plugs are secured relative to said socket and when said button is disposed in a second disposition relative to said socket, said first and second plugs are released from said socket;

said first plug including an attaching portion for attaching said first plug to the first strap;

a tongue projecting from said attaching portion for insertion into said socket, said tongue defining an opening;

a first and a second slide disposed spaced and parallel relative to each other so that said tongue is disposed between said first and second slide;

said second plug including a further attaching portion for attaching said second plug to the second strap;

a further tongue projecting from said further attaching portion for insertion into said socket, said further tongue defining a further opening;

a first and a second rail disposed spaced and parallel relative to each other so that said further tongue is disposed between said first and second rail;

said socket defining a first and a second hole, said first hole slidably receiving therein said tongue of said first plug, said second hole slidably receiving therein said further tongue of said second plug;

a catch which engages said opening when said tongue is inserted into said first hole such that said first plug is secured relative to said socket;

a further catch which engages said further opening when said further tongue is inserted into said second hole such that said second plug is secured relative to said socket, the arrangement being such that when said button is disposed in said first disposition, said tongue and further tongue are secured within said socket and when said button is disposed in said second disposition thereof, said button deflects said tongue and said further tongue away from said catch and further catch respectively so that said opening disengages from said catch and said further opening disengages from said further catch such that said first and second plugs are released from said socket;

said button includes a first depending leg which cooperates with said tongue and said further tongue so that when said button is disposed in said second disposition thereof, said first leg deflects said tongue and said further tongue so that said catch disengages from said opening and said further catch disengages from said further opening;

a second depending leg which cooperates with said tongue and said further tongue so that when said button is disposed in said second disposition thereof, said second leg deflects said tongue and said further tongue so that said catch disengages from said opening and said further catch disengages from said further opening, said second leg being disposed opposite to said first leg;

said first leg includes a first and a second member, said first member cooperating with said tongue and said second member cooperating with said further tongue;

said second leg includes a first and a second portion, said first portion cooperating with said tongue and said second portion cooperating with said further tongue; and said socket including a partition disposed between said first hole and said second hole for partitioning said first hole from said second hole, the arrangement being such that said partition is disposed between said first member and said second member, said partition also being disposed between said first portion and said second portion;

wherein depression of said button to said second disposition thereof simultaneously releases both plugs from said socket.

20. A buckle device comprising:

a first plug attachable to a first strap;

a second plug attachable to a second strap;

a socket attachable to a third strap, the socket being adapted to receive the first and second plugs; and a separate and distinct release button operatively secured to the socket, such that when the release button is disposed in a first position relative to the socket, the first and second plugs are secured to the socket, and such that when the release button is disposed in a second position relative to the socket, the first and second plugs are released from the socket, the release button being free to float or move between the first and second positions without additional outside force being applied thereto until such time as at least one of the first and second plugs is received by and secured to the socket, thereby causing the release button to resume and be positioned in the first position.

* * * * *